US011274840B2

(12) United States Patent
Bucsa et al.

(10) Patent No.: US 11,274,840 B2
(45) Date of Patent: Mar. 15, 2022

(54) VENT FOR USE IN AN HVAC SYSTEM

(71) Applicant: TYCO SAFETY PRODUCTS CANADA LTD., Concord (CA)

(72) Inventors: Andrei Bucsa, Concord (CA); Rob Vandervecht, Acton (CA); Gregory W. Hill, Newmarket (CA)

(73) Assignee: JOHNSON CONTROLS TYCO IP HOLDINGS LLP, Milwaukee, WI (US)

( * ) Notice: Subject to any disclaimer, the term of this patent is extended or adjusted under 35 U.S.C. 154(b) by 358 days.

(21) Appl. No.: 15/791,534

(22) Filed: Oct. 24, 2017

(65) Prior Publication Data

US 2019/0120511 A1 Apr. 25, 2019

(51) Int. Cl.

| | |
|---|---|
| ***F24F 11/00*** | (2018.01) |
| ***F01D 15/10*** | (2006.01) |
| ***F24F 11/76*** | (2018.01) |
| ***F01D 1/22*** | (2006.01) |
| ***F24F 13/06*** | (2006.01) |
| ***F24F 11/74*** | (2018.01) |
| ***F24F 13/14*** | (2006.01) |

(52) U.S. Cl.

CPC ..... *F24F 11/0001* (2013.01); *F01D 1/22* (2013.01); *F01D 15/10* (2013.01); *F24F 11/74* (2018.01); *F24F 11/76* (2018.01); *F24F 13/06* (2013.01); *F05D 2220/76* (2013.01); *F05D 2260/903* (2013.01); *F24F 2013/1433* (2013.01)

(58) Field of Classification Search

CPC ..... F24F 11/46; F24F 11/47; F01D 5/04

See application file for complete search history.

(56) References Cited

U.S. PATENT DOCUMENTS

| | | | | |
|---|---|---|---|---|
| 5,364,304 | A * | 11/1994 | Hampton | F24F 3/044 236/49.3 |
| 9,618,222 | B1 | 4/2017 | Hussain et al. | |
| 9,723,380 | B2 | 8/2017 | Patel et al. | |
| 2008/0277486 | A1 | 11/2008 | Seem et al. | |

(Continued)

OTHER PUBLICATIONS

BCcampus Open Textbooks, College Physics, "Back Emf", PDF provided, URL https://opentextbc.ca/physicstestbook2/chapter/back-emf/, Accessed Oct. 16, 2019, Available Jan. 23, 2012 (Year: 2012).*

(Continued)

*Primary Examiner* — Steven B McAllister
*Assistant Examiner* — Elizabeth M. May
(74) *Attorney, Agent, or Firm* — Arent Fox LLP

(57) ABSTRACT

An improved HVAC vent is disclosed. The vent may include an air turbine positioned within a passageway for selectively enabling and preventing airflow. In use, the air turbine is selectively operable between first and second states. In the first state, the air turbine may be freely rotatable, via the airflow, so that the received airflow can move through the passageway. In the second state, rotation of the air turbine is controlled or prevented so that the received airflow is inhibited or substantially inhibited from moving through the passageway. The vent may also include a motor. In use, the motor may act an energy generator and as an active brake so that in the first state, rotation of the air turbine is used to charge a power storage unit, and in the second state, the motor limits rotation of the air turbine.

22 Claims, 5 Drawing Sheets

(56) References Cited

U.S. PATENT DOCUMENTS

| | | | | |
|---|---|---|---|---|
| 2010/0295305 | A1* | 11/2010 | Mahawili | F03D 7/0268 290/44 |
| 2015/0133043 | A1 | 5/2015 | Patel et al. | |
| 2016/0153674 | A1 | 6/2016 | Lancaster | |
| 2016/0178228 | A1 | 6/2016 | Shahabdeen | |
| 2017/0122121 | A1* | 5/2017 | Rejniak | F01D 15/10 |
| 2017/0176034 | A1 | 6/2017 | Hussain et al. | |
| 2018/0170537 | A1* | 6/2018 | Hachtmann | F03D 9/25 |

OTHER PUBLICATIONS

"Ecovent is the Ultimate Climate Control System for the Home," https://www.ecoventsystems.com/smart, Copyright Ecovent Systems, Inc. pp. 1-5, Sep. 7, 2017.

"Be comfortable Save energy.," https://keenhome.io/smart-vent, Copyright 2017 Keen Home Inc, pp. 1-14, Sep. 7, 2017.

* cited by examiner

VENT FOR USE IN AN HVAC SYSTEM

FIELD OF THE DISCLOSURE

The present application relates generally to the field of heating, ventilation, and air conditioning (HVAC) systems. More specifically, the present application relates to an improved vent for use in existing or new HVAC systems.

BACKGROUND OF THE DISCLOSURE

Building services systems are often employed in residential homes, office buildings, schools, manufacturing facilities, and the like, for controlling the internal environment of the building. Building services systems may be employed to control temperature, airflow, humidity, lighting, energy consumption, power, security, fluid flow, and other similar building systems. Some building services systems are specifically directed to heating, ventilation, and/or air conditioning ("HVAC") systems. HVAC systems commonly seek to provide thermal comfort, acceptable air quality, ventilation, and controlled pressure relationships within buildings.

HVAC systems typically include an HVAC control system or station, one or more ventilation devices, and associated ductwork. The ventilation devices may include, for example, an air handling unit, which may include a blower, one or more heating and/or cooling elements, air filters, dampers, etc. Air handling units are typically connected to the ductwork which extends throughout the building or structure to provide an air distribution network. Ductwork typically terminates at a vent in a room. Most common blowers within HVAC systems operate at a single speed.

HVAC systems may also include a number of additional devices to supply controlled airflow to a building or building zone. A "zone" is typically a section of a building containing one or more rooms. In modern systems, an HVAC control system may provide a variety of inputs to and accept a variety of outputs from, for example, dampers, actuators, control circuits, environmental sensors including, for example, flow sensors, temperature sensors, occupancy sensors, etc. associated with various zones. Using these inputs and outputs, an HVAC control system may control the heating, ventilation, and air conditioning provided to specific building zones. For example, an HVAC control system may receive inputs from sensors related to an airflow rate and temperature of a building zone and use a damper and its accompanying actuator to appropriately position the damper such that a desired airflow rate is provided to the building zone.

Typical HVAC control systems use a plurality of sensors to monitor HVAC variables to be controlled, such as temperature, humidity, or airflow rate. An HVAC control system may typically regulate these controlled variables by considering a feedback signal generated by a sensor disposed to monitor the controlled variable. For example, an HVAC control system may allow or generate more airflow into a building zone based on a sensed temperature level. For example, if a sensed temperature level of a particular zone is at 85 degrees Fahrenheit, the HVAC control system may allow, generate, redistribute or supply more airflow into the zone to reach a desired lower temperature target or set point. If a temperature set point is 72 degrees Fahrenheit, for example, the HVAC control system may determine that airflow supply rate should be near maximum to rapidly make up the thirteen-degree difference. In a feedback-based system, the resulting changed temperature is periodically sensed and looped back into the HVAC control system via inputs from temperature sensors, and further adjustments may be made based on the changed data. This process may be looped or repeated in a near infinite manner whereby the HVAC control system may constantly be adjusting variables of operation based on feedback from various system sensors.

One problem commonly associated with HVAC systems is that most HVAC systems incorporate building zone-level control. As noted above, a zone may be a relatively large area or section of a building containing many rooms. In fact, in most residential buildings with centralized air conditioning, the entire building or home is maintained as a single zone. In other buildings, for example, the entire building may be divided into two zones. The first zone may be associated with a first level of a home or building encompassing all of the rooms on that level, while the second zone may be associated with a second level of the home or building encompassing all of the rooms on that level. Such systems are considerably inefficient because many portions of a section of a building or zone may be unoccupied at any given time. However, because of the building zone-level control, these unoccupied areas in a building zone are heated or cooled the same as occupied areas in the building zone.

One proposed solution to this known problem is the use of smart vents to divide a building zone dynamically into thermal profiled sub-zones so that the temperature in each sub-zone may be precisely controlled, resulting in greater efficiency and increased cost savings. For example, incorporation of smart vents may enable each room in a building zone to be independently controlled. As such, for example, in a residential building, bedrooms may be independently controlled as compared to a living space, kitchen, bathroom, etc. similarly located in the building zone depending on environmental factors, such as, for example, current temperature, time-of-day, ambient t, occupancy, etc.

Currently, known smart vents operate by using batteries to power a motor based actuator open and/or close the vents to regulate airflow. In addition, known smart vents incorporate wireless transceivers to wirelessly connect the smart vents with a home monitoring or home automation system. One problem with such systems is that the use of actuators, unnecessarily drains power from batteries used to power the motors and thus limits continuous airflow regulation. In addition, opening and closing of the vents exposes the system to excess dust and potentially mechanical tampering, thus requiring increased maintenance. Moreover, in order to properly comply with building codes, actuator based smart vents must prevent total closure of the vents when actuation power is missing (i.e., batteries are depleted), thus resulting in increased complexity.

As such, there is a need for an improved vent that overcomes the disadvantages associated with the known prior art. Other features and advantages will be made apparent from the present specification. The teachings disclosed extend to those embodiments that fall within the scope of the claims, regardless of whether they accomplish one or more of the aforementioned needs.

SUMMARY OF THE DISCLOSURE

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Disclosed herein is a vent for use in a HVAC system. In one embodiment, the vent may include a housing having an inlet for receiving airflow, an outlet for passing air into an associated room, and a passageway between the inlet and outlet. The vent may further include an air turbine positioned within the passageway for selectively enabling and preventing airflow from the inlet to the outlet. The air turbine may be selectively operable between first and second states. In the first state, the air turbine may be freely rotatable with respect to the housing so that received airflow can move through the passageway and the outlet. In the second state, rotation of the air turbine may be controlled so that received airflow is restricted between the inlet and the outlet. In the second state, the air turbine may be prevented from rotating with respect to the housing so that received airflow is substantially prevented from moving through the passageway and the outlet. The air turbine may extend longitudinally across the outlet, and may have a size and shape that substantially corresponds to a size of the passageway.

The vent may also include a motor operably associated with the air turbine. In one embodiment, the air turbine may be mounted onto a longitudinally extending shaft. The motor may be located exterior of the housing with the shaft passing thru a surface of the housing. In use, in the first state, the motor may act so that rotation of the air turbine is used to charge a power storage unit (e.g., a supercapacitor). Alternatively, and/or in addition, in the second state, the motor may act to limit or control rotation of the air turbine.

The vent may further include or be associated with a microcontroller and a transceiver. In use, the microcontroller and the transceiver may be powered by the power storage unit. The vent may further include an active load circuit, electrically coupled to the microcontroller. The active load circuit controlling a load associated with the motor and used to modulate the speed of the turbine and consequently the airflow through the vent. The load may control a back electromotive force associated with the motor and the speed of the turbine.

The vent may further include or be associated one or more environmental sensors for monitoring one or more environmental parameters of the associated room. In addition, the vent may include or be associated with a control station. The control station receiving the one or more environmental parameters and transmitting instructions to the microcontroller to operate in either the first or second state based on the received environmental parameters. The one or more environmental sensors may include a temperature sensor for monitoring a temperature of the associated room.

In another embodiment, the vent may include a housing having an inlet for receiving airflow, an outlet for passing air into an associated room, and a passageway between the inlet and outlet. The vent may further include an air turbine positioned within the passageway for selectively enabling and preventing airflow from the inlet to the outlet, and a motor operably associated with the air turbine. The vent may be selectively operable between first and second states. In the first state, the air turbine may be rotatable with respect to the housing via the received airflow so that the received airflow can move through the passageway and the outlet, and the motor may be arranged and configured to convert at least a portion of the rotatable movement of the air turbine into stored energy. In the second state, rotation of the air turbine may be controlled so that the received airflow is regulated, and the motor may act to limit rotation of the air turbine. In the second state, the air turbine may be prevented from rotating with respect to the housing so that the received airflow is substantially prevented from moving through the passageway and the outlet.

An HVAC system is also disclosed. The HVAC system may include one or more environmental sensors for monitoring one or more environmental parameters of an associated room, a control station for receiving the one or more environmental parameters, and one or more vents. Each vent may include a housing including an inlet for receiving airflow, an outlet for passing air into the associated room, and a passageway between the inlet and outlet. Each vent may further include an air turbine positioned within the passageway for selectively enabling and preventing airflow from the inlet to the outlet. In use, based on the received environmental parameters, the control station may transmit instructions to the one or more vents to operate in either a first state or a second state. In the first state, the air turbine may be freely rotatable with respect to the housing so that received airflow can move through the passageway and the outlet. In the second state, rotation of the air turbine may be controlled so that received airflow is regulated. In the second state, the air turbine may be prevented from rotating with respect to the housing so that received airflow is substantially prevented from moving through the passageway and the outlet.

Each vent may further include a motor operably associated with the air turbine. In the first state, the motor may convert at least a portion of the rotation of the air turbine to stored electric energy for powering a microcontroller associated with the vent. In the second state, the motor may act to limit rotation of the air turbine. In addition, the vents may include an active load circuit, electrically coupled to the microcontroller. The active load circuit controlling a load associated with the motor and used to modulate the speed of the turbine and consequently the airflow through the vent.

BRIEF DESCRIPTION OF THE DRAWINGS

By way of example, a specific embodiment of the disclosed device will now be described, with reference to the accompanying drawings, in which.

DETAILED DESCRIPTION

Figure 1A:
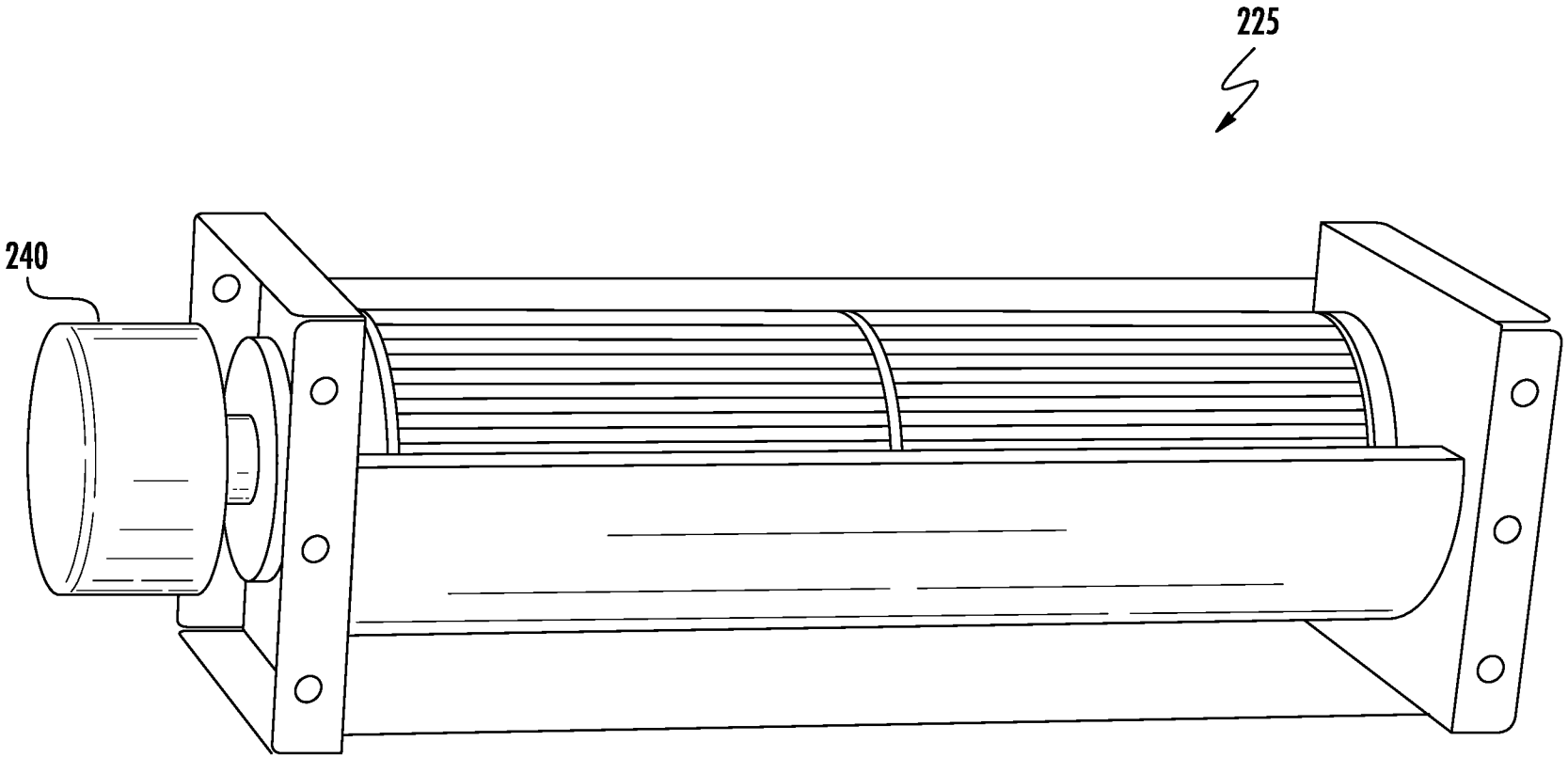
FIG. 1A is a front, perspective view of an exemplary embodiment of an air turbine according to the disclosure.

Before turning to the figures which illustrate exemplary embodiments of the present disclosure in detail, it should be understood that the application is not limited to the details or methodology set forth in the following description or illustrated in the figures. It should also be understood that the phraseology and terminology employed herein is for the purpose of description only and should not be regarded as limiting.

In general, and referring generally to the FIGURES, a vent according to the present disclosure may include an air turbine for selectively enabling and preventing airflow. In use, the vent may be installed in place of conventional air vents for use in a HVAC system. The HVAC system may include a furnace for supplying hot air, an air conditioner for supplying cold air, a blower for moving the hot or cold air, associated ductwork for distributing the hot or cold air throughout a building, one or more environmental sensors for sensing environmental parameters in one or more rooms of the building, and an HVAC control system or station (used interchangeably herein without the intent to limit) for controlling the HVAC system. The ductwork may terminate in a vent in each room. The vent may be positioned anywhere in the room, for example, in the ceiling, the walls, the floor, etc.

An exemplary building or home may include a living space, a dining space, a kitchen, one or more bedrooms, one or more bathrooms, an office space, closets, storage space, a laundry room, etc. The building may also house any number of people, lights, and other equipment. In use, some rooms may incorporate one or more windows, skylights, etc., while other rooms may be completely devoid of any natural lighting. The building may encompass a single floor. Alternatively, the building may include more than one floor. The building may include any number of rooms in any number of configurations.

It should also be noted that while the building is described as be a residential building, it may be a commercial building, an industrial building, an institutional building, a healthcare facility, a school, a manufacturing plant, an office building, or any other building that makes use of HVAC systems.

The building may include one or more HVAC zones. For purposes of illustration only, as is the case for most, single-level residential homes, the building will be described as containing a single HVAC zone. However, it should be understood that the building may contain multiple zones. As will be generally appreciated by one of ordinary skill in the art, certain rooms in a building are more likely to be occupied during daytime hours, for example, the living room, the dining room, and the kitchen, while other rooms, for example, the bedrooms, are more likely to be occupied during nighttime hours. In addition, some rooms may tend to run warmer than others. For example, rooms with exposure to natural lighting tend to be warmer during daylight hours. Moreover, in certain rooms, heating or cooling the room isn't as critical as compared to other rooms, for example, cooling the laundry room.

Yet, in existing systems, because the entire home is treated as a single zone, temperature is often set for the entire home without regard to occupancy, time of day, exposure to natural light, etc.

In accordance with one aspect of the present disclosure, an improved vent may be used to control, regulate or modulate an amount of airflow moving through the vent. Ideally, the vent controls the amount of airflow moving through the vent based on the sensed environmental conditions of each individual room in which the vent is located.

Figure 1B:
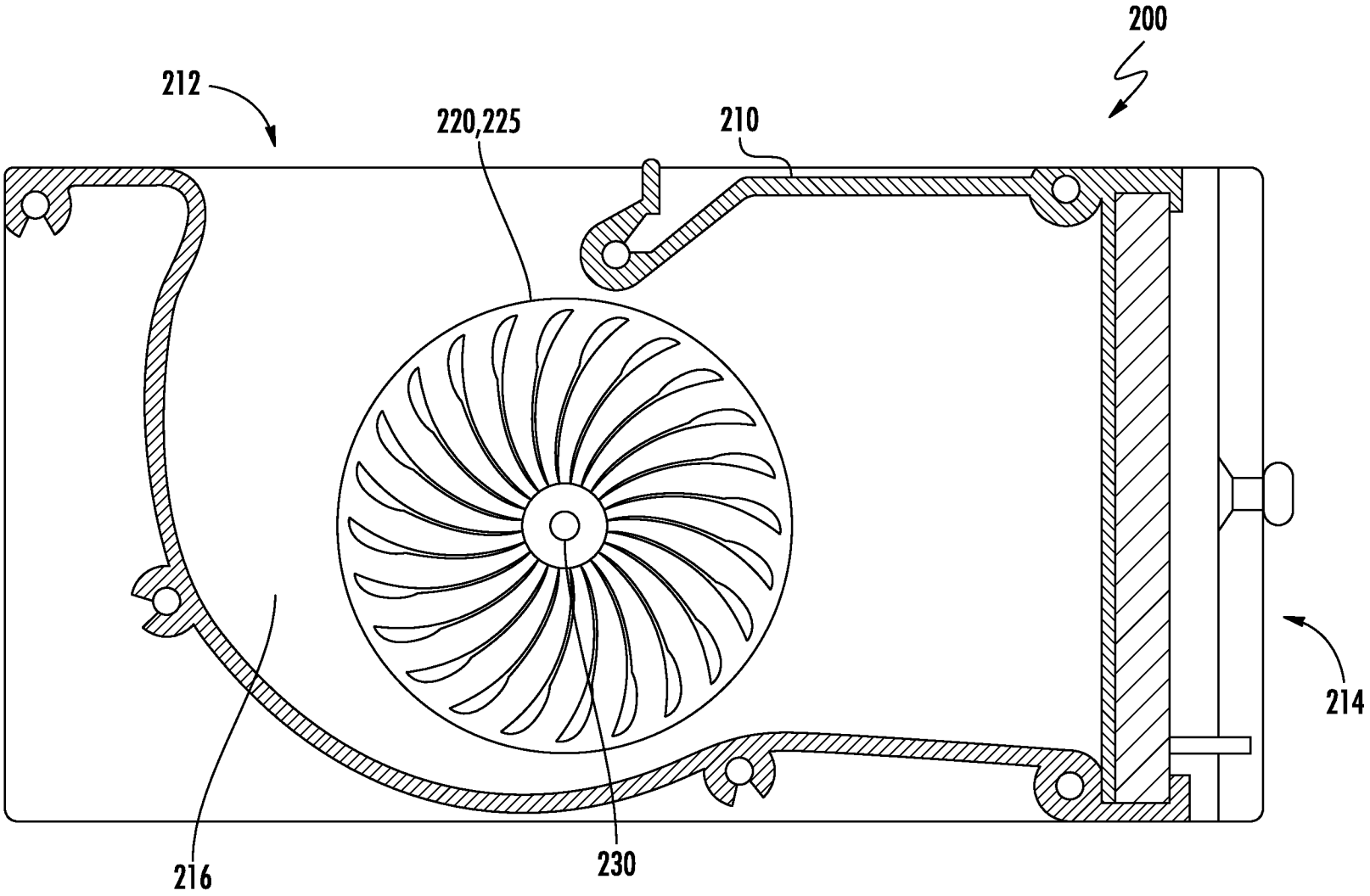
FIG. 1B is a cross-sectional view of an exemplary embodiment of a vent incorporating the air turbine shown in FIG. 1A according to the disclosure.
Figure 1C:
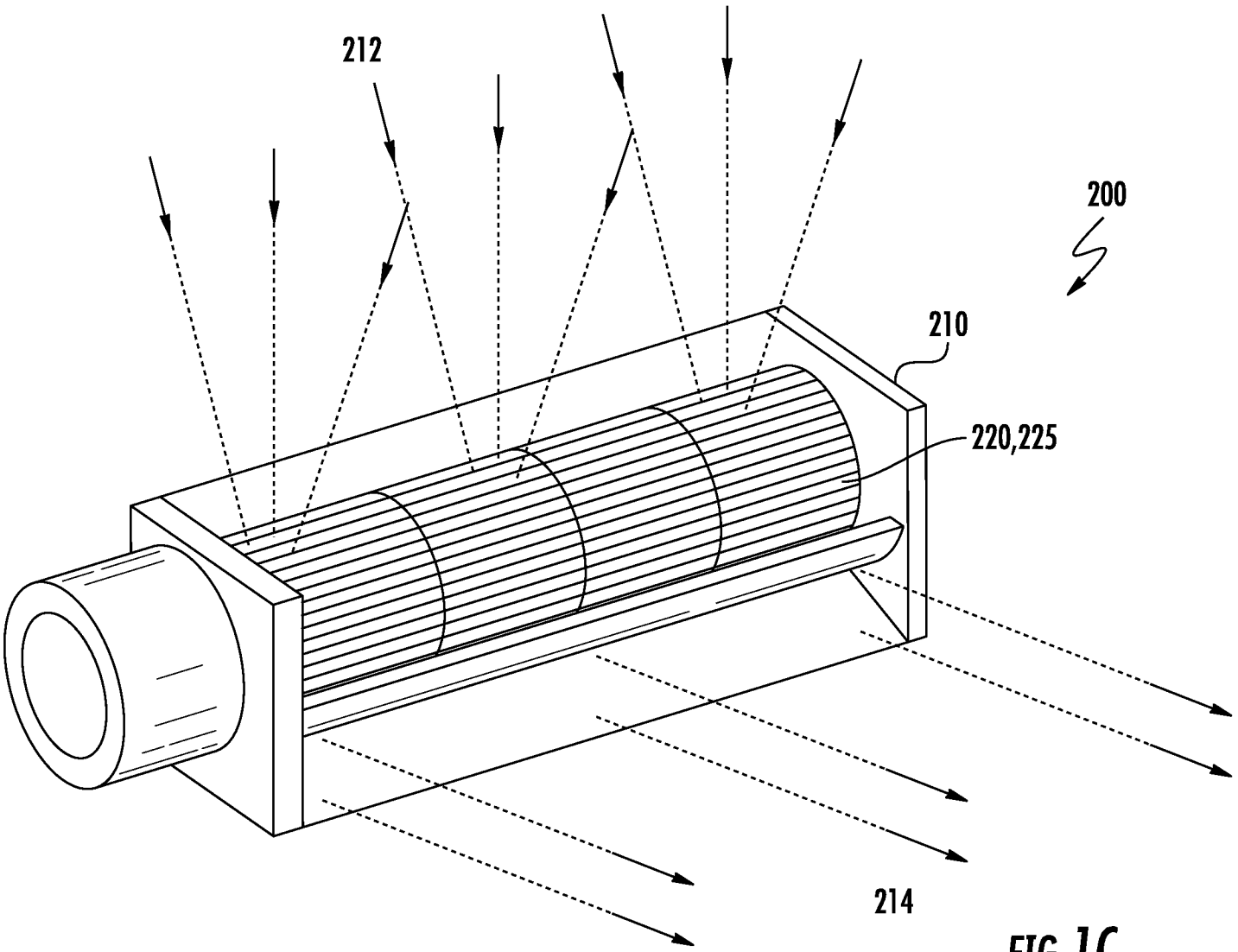
FIG. 1C is a partial, front, perspective view of the vent shown in FIG. 1B schematically illustrating the inflow and outflow of air.

Referring to FIGS. 1A-1C, an improved vent according to an example embodiment of the present disclosure is illustrated. As illustrated in FIG. 1B, the vent 200 may include a housing 210. The housing 210 may have any shape including, for example, rectangular, cylindrical, etc. As illustrated in FIGS. 1B and 1C, the housing 210 may include an inlet 212 for receiving airflow, an outlet 214 for passing air into the associated room, and a passageway 216 between the inlet 212 and the outlet 214.

The vent 200 may also include an air blocking mechanism 220 located in the passageway 216 between the inlet 212 and the outlet 214 for selectively enabling and preventing airflow. As best illustrated in FIGS. 1A-1C, the air blocking mechanism 220 may be in the form of an air turbine 225.

Referring to FIG. 1A, and as will be described in greater detail below, the vent 200 may also include a motor 240 operably associated with the air turbine 225. In use, as previously mentioned, the air turbine 225 may be located within the housing 210 between the inlet 212 and the outlet 214 for selectively enabling and preventing airflow. In use, the motor 240 may be located outside of the housing 210. The air turbine 225 may be mounted onto a longitudinal central shaft 230 (FIG. 1B) that extends thru the housing 210 for receipt by the motor 240. In one embodiment, the motor 240 may be a brushless motor. Additionally, the motor 240 may be connected to the longitudinal central shaft 230 through a reduction mechanism. However, it should be understood that the motor may be in other forms. For example, in one embodiment, the motor may be located in or part of the core of the air turbine. That is, the longitudinal shaft with coils may be the stator and the rotor may be in the form of the core of the air turbine surrounded by magnets. This embodiment provides the added benefit that the motor can be cooled via the airflow.

In use, the air turbine 225 may be configured to be freely rotatable within the passageway 216 of the vent 200 so that as air is moved through the vent 200, the air is allowed to move past the air turbine 225 via rotation of the air turbine 225. That is, airflow through the passageway 216 of the vent 200 causes the air turbine 225 to rotate. As such, the vent 200 does not rely on any electrical energy or power to rotate the air turbine 225. In addition, during rotation of the air turbine 225, the motor 240 converts the rotation movement (e.g., kinetic energy) of the air turbine 225 into electrical power, which may be stored in a power storage device to power, for example, a microcontroller and/or environmental sensors, as will be described in greater detail below.

That is, in use, the air turbine 225 is selectively operable between first and second states. In the first state, the air turbine 225 is freely rotatable so that air from the blower of the HVAC system is able to freely pass from the ductwork through the inlet 212, past the air turbine 225, through the outlet 214 of the vent 200 and into the associated room. In the second state, the air turbine 225 is prevented from rotation so that air from the blower of the HVAC system is prevented or substantially inhibited from moving past the air turbine 225. In this manner, in the second state, the air turbine 225 acts to block or substantially prevent passage of the air from entering the associated room.

As best illustrated in FIG. 1B, the air turbine 225 may extend longitudinally across the opening of the vent 200. Preferably, the air turbine 225 has a size and shape that substantially corresponds to the size of the passageway 216 formed in the vent 200. In this manner, in the second state, as previously mentioned, the air turbine 225 acts as a wall to block or substantially inhibited the passage of air. Meanwhile, in the first state, when the air turbine 225 is permitted to rotate, the incoming air rotates the air turbine 225 and thus is permitted to move past the air turbine 225 and into the associated room.

In addition, as will be described in greater detail below, in the first state, rotation of the air turbine 225 may be used to charge a power storage unit, such as, for example, a supercapacitor. In this manner, the air turbine 225 may act as an energy generator. As will be described in greater detail below, the supercapacitor may be used to power one or more electronic components associated with the vent 200. For example, in one embodiment, the supercapacitor may be used to store the required energy to supply a transmitter with peak current, and to transmit information such as, for example, status, data, etc., after the air turbine stops rotating.

The power storage unit may be used to supply power to a microcontroller associated with the vent, a transceiver used for communicating with, for example, the HVAC control station, one or more environmental sensors, etc. In contrast to known prior art systems however, the energy stored in the power storage unit is not used to open or close a motorized vent. That is, in the vent 200 of the present disclosure, the air turbine 225 is moved by airflow, and as such, the vent 200 does not rely on any electrically actuated actuators to enable or prevent airflow distribution.

As previously mentioned, the motor 240 may act as an energy generator. In the first state, the motor 240 may use the kinetic movement or rotation of the air turbine 225 to charge the power storage unit. That is, in the first state, when the amount of energy required is minimal, for example, on the order of tens of microwatts (uW) to power the circuitry, the total current will be Ih (because $I_{Load}=0$) where $I_h$ is the current required by the power conversion circuit. In return, this small current creates a small back electromotive force ("Back EMF"), which generates a small amount of braking which can be neglected (the rotation speed of the air turbine 225 will remain substantially constant). In any event, during the first state, the circuitry is being powered and the power storage unit is being charged. In the first state, during periods of peak energy, additional energy can be supplied via the power storage unit (e.g., supercapacitor).

Meanwhile, in the second state, the motor 240 may act as an energy generator and an active brake to regulate the airflow through the vent 200. For example, by using the motor 240 as a generator, the vent 200 can convert the mechanical energy from the rotating air turbine 225 back into electrical energy, which can be stored in the power storage unit. Meanwhile, in the second state, the motor 240 can also act as a braking system to prevent rotation of the air turbine 225 thereby effectively sealing most of the passageway 216 between the inlet 212 and the outlet 214. That is, in the second state, the motor 240 can prevent rotation of the air turbine 225 thus blocking or substantially inhibited the passage of air.

Figure 2:
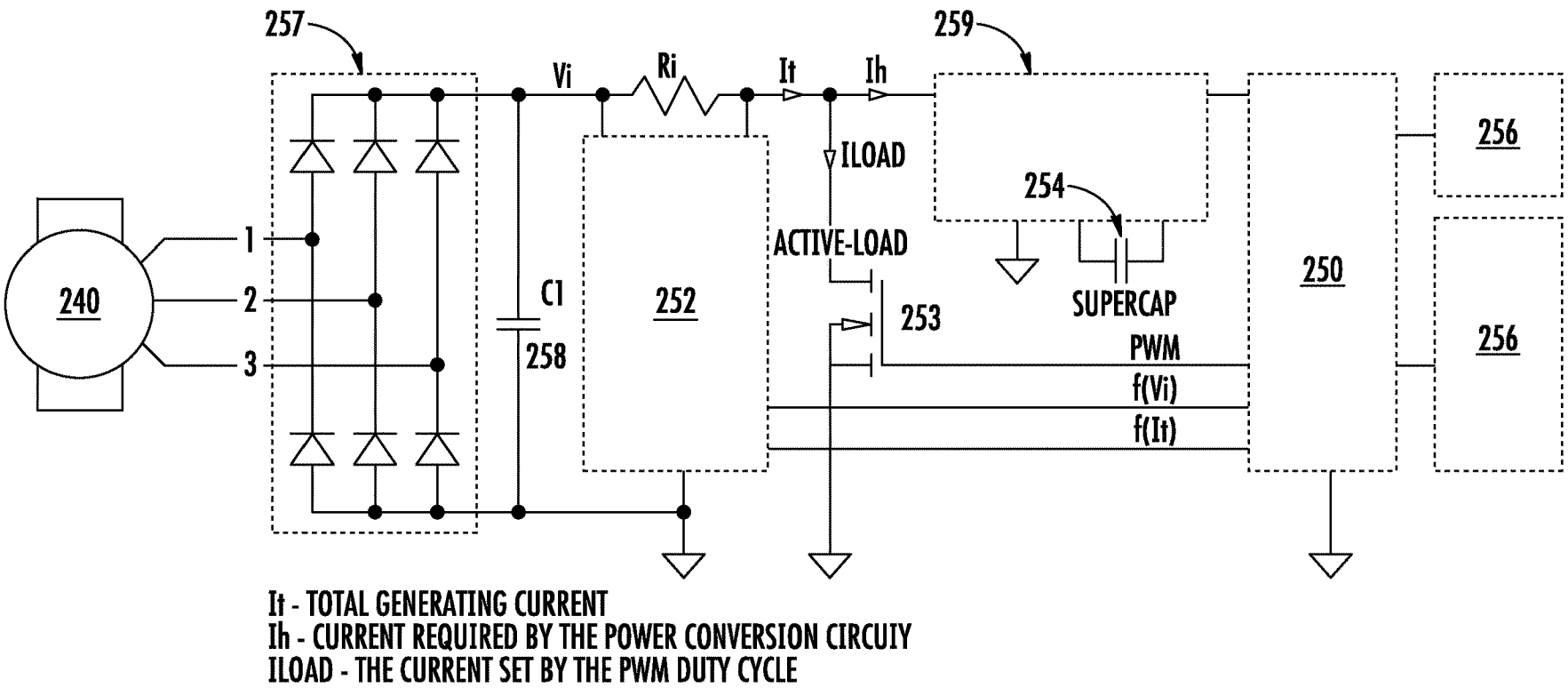
FIG. 2 is an exemplary circuit diagram for use in combination with the vent shown in FIG. 1B.

Referring to FIG. 2, in the second state, in addition to the small load present in the first state to, for example, power the circuitry and charge the power storage unit, a second, active-load circuitry 253 may be applied in parallel. In use, the active-load 253 may be orders of magnitude larger than the first load and will cause the motor to break. Referring to FIG. 2, the active-load 253 may be in the form of an active resistance, a current source, or a pulse-width modulation ("PWM") load that is controlled by the microcontroller 250. In use, a majority of the generated power will be dissipated as thermal heat on the active-load 253. In addition, a part of the kinetic energy may be transformed into power before being dissipated as heat, to slow or prevent the rotation of the turbine. The speed of the turbine can be estimated by calculating the instantaneous transferred power, which is a function of rectified voltage, total current It and the applied load (PWM duty cycle). One of ordinary skill in the art will also appreciate that the total current It is also a function of, inter alia, air duct pressure, motor characteristics such as, for example, internal resistance, etc. However, for purposes of this disclosure, the air distribution ratio between vents can be adjusted by setting the required load ranging from no load, so that the air is free to pass through selected vents, up to maximum load, where air is prohibited from passing through selected vents.

Referring to FIG. 2, the vent 200 may further include a microcontroller, processor or local controller 250 (collectively referred to herein as a microcontroller without the intent to limit), a power rectifying circuit 257, 258 to rectify the power from the generator (e.g., motor 240), a power delivery evaluation circuit 252, a power charger 259, and a power storage unit 254, which may be in the form of a supercapacitor. In one embodiment, the active-load 253 may be a MOSFET controlled by PWM or other circuitry acting as a controlled current load, although it is envisioned that other types of loads may be used. As such, control of the local operations of the vent 200 may be provided by the microcontroller 250, which is powered by the power storage unit 254.

The microcontroller 250 may be communicatively coupled to a number of inputs and/or outputs 256. The inputs and/or outputs may be used to receive and/or transmit information, data, instructions, etc. from, for example, environmental sensors, HVAC control system, etc. As illustrated, the microcontroller 250 and the inputs and/or outputs 256 are electrically coupled to the power storage unit 254. In this manner, as will be described in greater detail below, the microcontroller 250 and/or sensors, transceivers, etc. coupled to the inputs and/or outputs 256 may be powered by the power storage unit 254. That is, the power stored in the power storage unit 254 may be used to power the microcontroller 250, which is used to regulate the amount of airflow through the vent 200 and to power the transceivers to enable communication with the sensors and/or control system.

In accordance with one embodiment of the present disclosure, the vent 200 may include, be associate with, or operate in conjunction with, either directly or indirectly, a control system or station. In addition, the vent 200 may include, be associate with, or operate in conjunction with, either directly or indirectly, for example, through the control station, one or more environmental sensors. In this manner, the environmental sensors may be able to detect an environmental parameter, such as, for example, a temperature for each room and transmit that information to the control station. Thereafter, based on the information received from, inter alia, the environmental sensors, the control station can determine and instruct each vent 200 so as to achieve room-level temperature control in a centralized HVAC system to thereby conserve energy usage.

In one embodiment, the HVAC system may include a control system and a plurality of environmental sensors for monitoring environmental parameters in each room. The environmental sensors may be any sensor now known or hereafter developed including, for example, temperature sensors, flow sensors, occupancy sensors, humidity sensors, etc. Data from the environmental sensors may be used to provide increased energy optimization in commercial and residential buildings. The environmental sensors may be communicatively coupled in any manner. For example, the environmental sensors may be directly coupled to the vent, they may be coupled directly or indirectly to the control station, etc. Additionally, the system may communicate by any means now known or hereafter developed including, for example, wireless and wired communications. For example, each of the vents 200 may incorporate wireless transceivers to wirelessly connect the vents 200 with a HVAC control station, a home monitoring system, a home automation system, etc. The wireless communication may be any now known or hereafter developed wireless communication protocol including, for example, message queue telemetry transport ("MQTT"), Bluetooth, near-field communication, Wi-Fi, etc.

In use, the environmental sensors may determine the actual temperature in each room, whether the room is occupied, etc. This information may be transmitted to the control system. Based on all of the inputs received including, for example, from the environmental sensors associated with each room, room type, time of day, etc., the control system may monitor the temperature of each room and, in accordance with the principles of the present disclosure, the control system may determine a desired airflow rate for each room. The control system may then use the determined desired airflow rate to independently control the airflow rate within each vent associated with each room. In use, the control system may either increase or decrease the airflow through the air turbine and through the vent to provide room-level control, as necessary.

Referring to FIG. 2, the microcontroller 250 may also be coupled to the power delivery evaluation circuit 252. In use, the power delivery evaluation circuit 252 may monitor the turbine speed and transmit monitoring parameters to the microcontroller 250. Based on the data received by the microcontroller 250, active load circuitry 253 controls the operation of motor 240. That is, as illustrated, based on the active load circuit 253 control received from the microcontroller 250, the Back EMF field inside the generator (e.g., motor 240) can be controlled and may be used to modulate the speed of the airflow past the air turbine 225 and through the vent 200. That is, by adjusting the load via, for example, a PWM signal, an analog signal, etc., the output current can be varied, which will generate an opposite to rotation magnetic field. In return, due to the Back EMF, the motor 240 will begin to decrease the rotation of the air turbine 225 and, as such, the amount of airflow past the air turbine 225 and through the vent 200. That is, as the load is increased, the motor 240 will begin to slow the rotation of the air turbine 225 since the Back EMF field created is opposite to the rotation of the motor 240 reducing the amount of airflow moving past the air turbine 225 and through the vent 200. Alternatively, when the microcontroller 250 is off, the motor 240 will freely spin because there is no or minimal load preventing the air turbine 225 from spinning. In one embodiment, the control energy injected from the microcontroller 250 to the active load circuitry 253, for example, PWM signal, a voltage control signal, etc., is used to set the desire load for breaking control. This load may be minimal. Alternatively, the load current ILoad used to slow the rotational speed of the motor/generator, and the energy dissipated as heat inside the motor and outside on the load circuitry, may be orders of magnitude higher.

Figure 3:
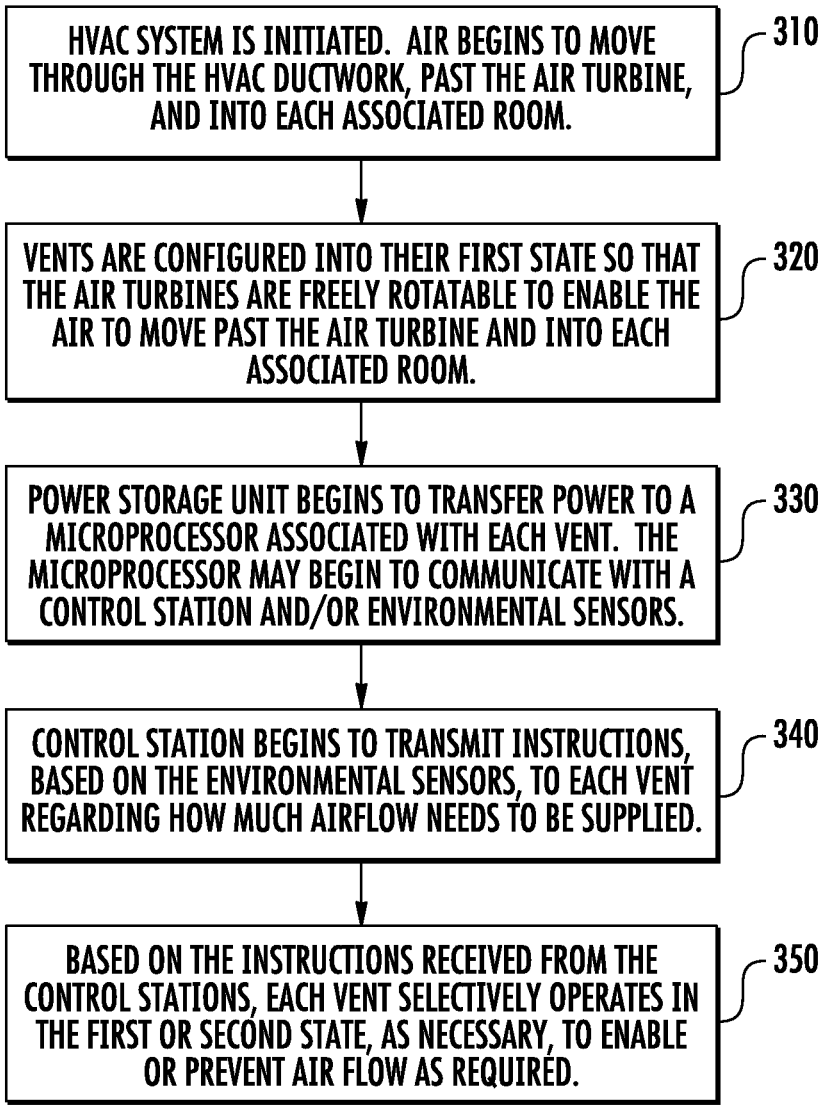
FIG. 3 is a logic diagram illustrating an exemplary method of operation.

Referring to FIG. 3 an exemplary method of operation 300 is illustrated. As illustrated, at 310, the HVAC system is initiated. Thus, cool or hot air begins to move through the ductwork, past the air turbine 225 and into each associated room. Initially, at 320, all of the vents 200 may be configured into their first state so that the air turbines 225 are freely rotatable. As previously mentioned, in the first state, rotation of the air turbine 225 charges the power storage unit (e.g., supercapacitor) 254 and no extra load will be applied. At 330, when the power storage unit 254 has achieved a predetermined set point, the power storage unit 254 begins to transfer power to the microcontroller 250 associated with each vent 200. At this stage, the microcontroller 250 may begin to communicate with a HVAC control station (not shown). At 340, based on sensed environmental parameters (e.g., temperature, time-of-day, ambient light, occupancy, etc.) from each respective room, the control station begins to transmit instructions to each vent 200 regarding how much airflow needs to be supplied. At 350, based on the instructions received from the control station, each vent 200 selectively operates in the first or second state, as necessary, to enable or prevent airflow as required.

For example, during summer months, a user may set their thermostat in a building zone at 70 degrees. However, the user may not want every room in the house to be maintained at the same temperature at all times of the day. For example, in a first room, such as, a bedroom where occupancy is expected to be sparse throughout the daylight hours or an office in a commercial building during evening hours, the system could be programmed to maintain a higher constant temperature of, for example, 75 degrees. Meanwhile, for example, in a second room, such as, a room with lots of ambient light, a kitchen, or a living space with lots of occupancy, the temperature may be too hot, for example, 73 degrees. As a result, the control station may transmit instructions to the vent 200 located in the first room to turn off or prevent its air turbine 225 from rotating. This, in turn, will cause a decrease in the amount of, for example, cold air being supplied to the first room. In addition, the control station may transmit instructions to the vent 200 located in the second room to enable the air turbine 225 to rotate. This, in turn, will cause an increased amount of cold air being supplied to the second room.

Alternatively, the vent 200 may be associated with, for example, an occupancy sensor so that if the occupancy sensor detects the presence of one or more persons in the room, the temperature can be maintained at the desired set point. However, if the occupancy sensor does not detect the presence of an occupant, the vent may, for example, adjust the amount of airflow moving past the air turbine and through the vent so as to conserve energy. For example, the vent may decrease the amount of airflow to increase the temperature in the room by, for example, a predetermine value (e.g., 3, 5, etc. degrees)

As will be generally understood by one of ordinary skill in the art, the total pressure or airflow for the entire HVAC system is constant. Thus, by preventing the air turbine 225 in the vent 200 associated with the first room from rotating, this will increase the amount of airflow available for the vent 200 associated with the second room.

As will be appreciated, the process of monitoring the environmental sensors can be an iterative process with continuous feedback. When the temperature in the first room exceeds the increased set point (e.g., 75 degrees), the control station can instruct the vent 200 in the first room to enable the air turbine 225 to begin to rotate, thus increasing the amount of airflow moving past the air turbine and into the first room, thereby decreasing the temperature in the first room. Similarly, when the temperature in the second room decreases below the set point (e.g., 70 degrees), the control station can instruct the vent 200 in the second room to enable the air turbine 225 to slow down or cease rotating, thus decreasing the amount of airflow moving past the air turbine and into the second room, thereby increasing the temperature in the second room.

In this manner, by incorporating the vents 200 according to the present disclosure, a user is able to provide room-by-room control within a building even when the building or home is zoned as a single zone. That is, in accordance with principles of the present disclosure, the airflow may be regulated by the air turbine so based on the turbine load, which may equate to the energy harvesting portion plus the PWM modulated artificial load, the air turbine may oppose more or less of the load, which will increase or decrease the amount of airflow being outputted. In this way, the air can be differently distributed inside the various rooms based on, for example, temperature. In addition, contrary to known, prior art systems, the vents 200 do not require a motorized actuator based louver system to operate.

An additional advantage of the vents according to the present disclosure is its backward compatibility to work with existing building management systems.

As described herein, the various components including, for example, the vent, environmental sensors, control station, etc. can be a part of a stand-alone system used in a single residence or an office suite. Alternatively, the system and/or components, may be part of a building management system.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision additional modifications, features, and advantages within the scope and spirit of the claims appended hereto.

What is claimed is:

1. A vent for use in a heating, ventilation, or air conditioning "HVAC" system, comprising:

a housing including an inlet for receiving airflow, an outlet for passing air into an associated room, and a passageway between the inlet and the outlet;

an air turbine positioned within the passageway for selectively enabling and preventing the airflow from the inlet to the outlet, wherein the air turbine is mounted onto a longitudinally extending shaft and extends longitudinally across the outlet and has a size and shape that substantially corresponds to a size of the passageway;

a motor connected to the longitudinally extending shaft;

wherein the air turbine is selectively operable between a first state and a second state;

wherein, in the first state, the air turbine is freely rotatable with respect to the housing so that the airflow is movable through the passageway and the outlet, and the motor converts a kinetic energy of the air turbine into electrical power that charges a power storage unit that powers a microcontroller that controls the vent; and wherein, in the second state, the microcontroller is powered by the power storage unit and is configured to control a speed of the air turbine to reach a desired temperature in the associated room by:

receiving monitoring parameters indicative of the speed of the air turbine;

receiving sensed environmental parameters of the associated room; and outputting, based on the monitoring parameters indicative of the speed of the air turbine and the sensed environmental parameters of the associated room, a pulse-width-modulation "PWM" signal that controls an active load circuitry that controls a load associated with the motor to modulate the speed of the air turbine and the airflow through the passageway and the outlet, wherein the speed of the air turbine is estimated by calculating an instantaneous transferred power as a function of a rectified voltage of the motor, a total current generated by the motor, and the load that is controlled by a PWM duty cycle of the PWM signal.

2. The vent of claim 1, wherein the power storage unit comprises a supercapacitor.

3. The vent of claim 1, wherein the longitudinally extending shaft passes through a surface of the housing.

4. The vent of claim 1, further comprising a transceiver.

5. The vent of claim 4, wherein the power storage unit powers the transceiver.

6. The vent of claim 1, wherein the total current generated by the motor is a sum of a first current that is required by a power conversion circuitry that charges the power storage unit and a second current that passes through the active load circuitry and is set by the PWM duty cycle of the PWM signal.

7. The vent of claim 1, wherein the load controls a back electromotive force associated with the motor and the speed of the air turbine.

8. The vent of claim 1, further comprising one or more environmental sensors for monitoring one or more environmental parameters of the associated room.

9. The vent of claim 8, further comprising a control station receiving the one or more environmental parameters and transmitting instructions to the microcontroller to operate in either the first state or the second state based on the one or more environmental parameters.

10. The vent of claim 8, wherein the one or more environmental sensors includes a temperature sensor for monitoring a temperature of the associated room.

11. A vent comprising:

a housing including an inlet for receiving airflow, an outlet for passing air into an associated room, and a passageway between the inlet and the outlet;

an air turbine positioned within the passageway for selectively enabling and preventing the airflow from the inlet to the outlet, wherein the air turbine is mounted onto a shaft;

a motor connected to the shaft;

wherein the vent is selectively operable between a first state and a second state;

wherein, in the first state, the air turbine is rotatable with respect to the housing via the airflow so that the airflow is movable through the passageway and the outlet, and the motor converts a kinetic energy of the air turbine into electrical power that charges a power storage unit that powers a microcontroller that controls the vent; and wherein, in the second state, the microcontroller is powered by the power storage unit and is configured to control a speed of the air turbine to reach a desired temperature in the associated room by:

receiving monitoring parameters indicative of the speed of the air turbine;

receiving sensed environmental parameters of the associated room; and outputting, based on the monitoring parameters indicative of the speed of the air turbine and the sensed environmental parameters of the associated room, a pulse-width-modulation "PWM" signal that controls an active load circuitry that controls a load associated with the motor to modulate the speed of the air turbine and the airflow through the passageway and the outlet, wherein the speed of the air turbine is estimated by calculating an instantaneous transferred power as a function of a rectified voltage of the motor, a total current generated by the motor, and the load that is controlled by a PWM duty cycle of the PWM signal.

12. A heating, ventilation, or air conditioning "HVAC" system, comprising:

one or more environmental sensors for monitoring one or more environmental parameters of an associated room;

a control station for receiving the one or more environmental parameters; and one or more vents, each vent including:

a housing including an inlet for receiving airflow, an outlet for passing air into the associated room, and a passageway between the inlet and the outlet;

an air turbine positioned within the passageway for selectively enabling and preventing the airflow from the inlet to the outlet, wherein the air turbine is mounted onto a longitudinally extending shaft;

a motor connected to the longitudinally extending shaft;

wherein, based on the one or more environmental parameters, the control station transmits instructions to the one or more vents to operate in either a first state or a second state;

wherein, in the first state, the air turbine is freely rotatable with respect to the housing so that the airflow is movable through the passageway and the outlet, and the motor converts a kinetic energy of the air turbine into electrical power that charges a power storage unit that powers a microcontroller; and wherein, in the second state, the microcontroller is powered by the power storage unit and is configured to control a speed of the air turbine to reach a desired temperature in the associated room by:

receiving monitoring parameters indicative of the speed of the air turbine;

receiving sensed environmental parameters of the associated room; and outputting, based on the monitoring parameters indicative of the speed of the air turbine and the sensed environmental parameters of the associated room, a pulse-width-modulation "PWM" signal that controls an active load circuitry that controls a load associated with the motor to modulate the speed of the air turbine and the airflow through the passageway and the outlet, wherein the speed of the air turbine is estimated by calculating an instantaneous transferred power as a function of a rectified voltage of the motor, a total current generated by the motor, and the load that is controlled by a PWM duty cycle of the PWM signal.

13. The HVAC system of claim 12, wherein the power storage unit comprises a supercapacitor.

14. The HVAC system of claim 12, wherein each vent further comprises a transceiver.

15. The HVAC system of claim 12, wherein the total current generated by the motor is a sum of a first current that is required by a power conversion circuitry that charges the power storage unit and a second current that passes through the active load circuitry and is set by the PWM duty cycle of the PWM signal.

16. The HVAC system of claim 12, wherein the load controls a back electromotive force associated with the motor and the speed of the air turbine.

17. The HVAC system of claim 12, wherein the longitudinally extending shaft passes through a surface of the housing.

18. The vent of claim 1, wherein the active load circuitry comprises a MOSFET.

19. The vent of claim 11, wherein the active load circuitry comprises a MOSFET.

20. The HVAC system of claim 12, wherein the active load circuitry comprises a MOSFET.

21. The vent of claim 1, wherein, when the microcontroller is off, the air turbine is in the first state and the motor is freely rotatable responsive to an absence of the PWM signal output by the microcontroller to prevent the air turbine from spinning.

22. The vent of claim 1, wherein the air turbine comprises:

the longitudinally extending shaft that is rotatable and that has a longitudinal length in a first direction substantially normal to a second direction of the airflow through at least a portion of the passageway;

a plurality of turbine blades connected to the longitudinally extending shaft, wherein each of the plurality of turbine blades have a body that extends in the first direction along the length of the longitudinally extending shaft and in a third direction extending away from the longitudinally extending shaft; and wherein in the second state, two of the plurality of turbine blades are positioned, in combination, to extend across the passageway to act as a wall to block or substantially inhibit passage of air.

* * * * *